US007074025B2

(12) United States Patent
Grethel

(10) Patent No.: US 7,074,025 B2
(45) Date of Patent: Jul. 11, 2006

(54) FLUID DELIVERY DEVICE

(75) Inventor: Marco Grethel, Bühlertal (DE)

(73) Assignee: LuK Lamellen und Kupplungsbau Beteiligungs KG, Bühl (DE)

( * ) Notice: Subject to any disclaimer, the term of this patent is extended or adjusted under 35 U.S.C. 154(b) by 0 days.

(21) Appl. No.: 10/821,618

(22) Filed: Apr. 10, 2004

(65) Prior Publication Data

US 2004/0258549 A1 Dec. 23, 2004

(30) Foreign Application Priority Data

Apr. 14, 2003 (DE) ..... 103 17 113

(51) Int. Cl.
*F03C 2/00* (2006.01)
*F04C 2/00* (2006.01)

(52) U.S. Cl. ..... 418/133; 418/75; 418/104; 418/125; 418/171

(58) Field of Classification Search ..... 418/125, 418/126, 104, 133, 75, 170, 166, 171
See application file for complete search history.

(56) References Cited

U.S. PATENT DOCUMENTS

| | | | | |
|---|---|---|---|---|
| 3,416,459 | A * | 12/1968 | Reimer et al. | 418/132 |
| 3,490,383 | A * | 1/1970 | Parrett | 418/149 |
| 3,718,411 | A * | 2/1973 | Pollman | 418/131 |
| 4,253,808 | A * | 3/1981 | White | 418/126 |
| 6,050,796 | A * | 4/2000 | Wong et al. | 418/132 |
| 6,425,747 | B1 * | 7/2002 | Buchmuller et al. | 418/170 |
| 6,481,990 | B1 * | 11/2002 | Wong et al. | 418/132 |

* cited by examiner

*Primary Examiner*—Theresa Trieu
(74) *Attorney, Agent, or Firm*—Alfred J. Mangels

(57) ABSTRACT

A fluid delivery device, such as a geared machine or a gear pump, with a housing having at least one supply chamber and a displacement unit arranged within the supply chamber. The displacement unit serves to supply a medium to at least one pressure chamber provided within the housing. A pressure plate is arranged between the pressure chamber and the housing, and the pressure plate is uncoupled from the housing by at least one spacer element that is arranged between the pressure plate and the housing to provide a fluid delivery device that operates more quietly than conventional fluid delivery devices.

12 Claims, 4 Drawing Sheets

FLUID DELIVERY DEVICE

BACKGROUND OF THE INVENTION

1. Field of the Invention

The present invention relates to a fluid delivery device, especially a geared machine or a gear pump, with a housing having at least one supply chamber as well as a displacement unit arranged within the supply chamber and which serves to supply a medium to at least one pressure chamber provided within the housing.

2. Description of the Related Art

Fluid delivery devices of the geared machine or gear pump type are especially used in drive trains, such as are installed, for example, in motor vehicles. In modern internal combustion engines, the noise developed by the fluid delivery device installation when the machine is in operation has been attributed increasing significance. Within the scope of the noise optimization process, the developers of fluid delivery devices, and especially of geared machines, such as internal gear pumps, are also required to minimize the noise that occurs when the device is in operation.

An object of the invention is accordingly to produce a fluid delivery device, especially a geared machine or a gear pump, with a housing having at least one supply chamber. A displacement unit is arranged within the supply chamber, wherein the displacement unit serves to supply a medium to at least one pressure chamber provided within the housing, and which operates more quietly than conventional geared machines.

SUMMARY OF THE INVENTION

That object is achieved by a fluid delivery device, especially a geared machine or a gear pump, with a housing having at least one suction chamber and a displacement unit arranged within the suction chamber. The displacement unit serves to supply a medium to at least one pressure chamber provided within the housing, and a pressure plate is arranged between the pressure chamber and the housing. The pressure plate is uncoupled from the housing by at least one spacer element that is arranged between the pressure plate and the housing. In the context of the present invention, studies that have been conducted have shown that during operation of conventional fluid delivery devices, especially geared machines or gear pumps, pressure fluctuations that act against the housing during operation, but not limited thereto, are conducted back and appear as noises. The pressure fluctuations, in turn, can be attributed to a discontinuous supply effect of the engaged gears, and are transmitted through the housing to other units that are coupled with the geared machine. By the interposition of the pressure plate, the housing is unloaded.

The pressure plate is formed and arranged in such a way that the pressure forces that would otherwise be exerted directly on the housing now first act on the pressure plate. The spacer elements that are located between the housing and the pressure plate significantly reduce the contact surface with the housing. In addition, the spacer elements act as dampers that reduce the transmission of structure-borne noise from the pressure plate to the housing. The spacer elements can be pointed or linear. The spacer elements are preferably made of metal, sintered materials, plastic, or ceramic. The spacer elements can also be made from an elastomeric material or formed as spring elements.

In accordance with one implementation, at least one pressure plate can be arranged on only one side, or on each of two sides, of the fluid delivery device. The housing of the fluid delivery device can be constructed of one or several parts, and, for example, can include a housing chamber that can be closed by a housing cover. The pressure plate can be arranged in the housing chamber, preferably in the bottom of the housing chamber, and/or in the housing cover.

A preferred exemplary embodiment of the fluid delivery device is characterized in that the pressure plate is arranged between the housing and an axial plate. The axial plate serves as axial clearance compensation and is axially arranged between the housing and the displacement unit. The pressure chamber is formed between the pressure plate and the axial plate. Accordingly, in an axial direction from the outside in, the following sequence is produced: housing—pressure plate—pressure chamber—axial plate—displacement unit. Axial plates and pressure plates can also be arranged on both sides of the fluid delivery device. What is fundamental with regard to the noise transmission is that a pressure plate is arranged between the pressure chamber and the housing in order to uncouple the housing from the pressure chamber.

An additional preferred embodiment of the fluid delivery device is characterized in that the pressure plate is received, at least partially, within a recess provided in the housing. The recess in the housing serves to position and to guide the pressure plate. In practical terms, the pressure plate functions as a piston that is received within the housing in such a way as to be movable back and forth within the recess, and that thereby serves to equalize pressure fluctuations in the pressure chamber.

An additional preferred embodiment of the fluid delivery device is characterized in that at least one seal is arranged between the pressure plate and the axial plate. The seal serves to seal off the pressure chamber. Accordingly, the seal is so arranged and so formed as to enable the pressure plate to move relative to the axial plate, at least to a slight degree.

An additional preferred embodiment of the fluid delivery device is characterized in that at least one groove is formed in the pressure plate and serves to partially hold the seal. By means of the groove, undesirable sliding of the seal is prevented.

An additional preferred embodiment of the fluid delivery device is characterized in that spacer elements are arranged between the pressure plate and the housing, both in the direction of the axis of rotation of the displacement unit and perpendicular thereto. That has the effect of securely preventing the pressure plate and the housing from coming in contact with each other when the fluid delivery device is in operation, in fact also when the pressure plate moves relative to the housing.

An additional preferred embodiment of the fluid delivery device is characterized in that the pressure plate is at least partially located within a recess provided in the axial plate. The recess in the axial plate serves to position and to guide the pressure plate. In practical terms, the pressure plate functions as a piston that is movable back and forth within the housing and thereby serves to equalize pressure fluctuations in the pressure chamber. That is, the pressure plate moves relative to the axial plate and the housing when the fluid delivery device is in operation, namely as a function of the pressure fluctuations that occur within the pressure chamber.

An additional preferred embodiment of the fluid delivery device is characterized in that at least one seal is arranged between the pressure plate and the axial plate. The seal serves to seal off the pressure chamber, in fact also when the pressure plate moves slightly relative to the axial plate and/or the housing.

An additional preferred embodiment of the fluid delivery device is characterized in that at least one groove is formed in the axial plate and serves to partially hold the seal. By means of the groove, undesirable sliding of the seal is prevented. In addition, the groove facilitates the assembly of the fluid delivery device, because the seal can be installed in the groove before assembly.

An additional preferred embodiment of the fluid delivery device is characterized in that the displacement unit includes a first gear, for example an internal gear, that is rotatably supported within the housing, wherein the first gear cooperates with a second rotatably supported gear, especially a driven gear, for example a pinion. The internal gear can be provided with internal teeth that are partially engaged with external teeth of the pinion. The pinion is preferably eccentrically supported relative to the internal gear.

BRIEF DESCRIPTION OF THE DRAWINGS

Additional advantages, features, and details of the invention appear in the following description that, with reference to the drawings, describes two illustrative embodiments in detail. The features set forth in the claims and in the description can be significant for the invention, either individually or in any desired combination. In the drawings:

FIG. 1 is a top view of a fluid delivery device housing wherein a displacement unit is not shown for reasons of clarity;

DESCRIPTION OF THE PREFERRED EMBODIMENTS

Figure 1A:
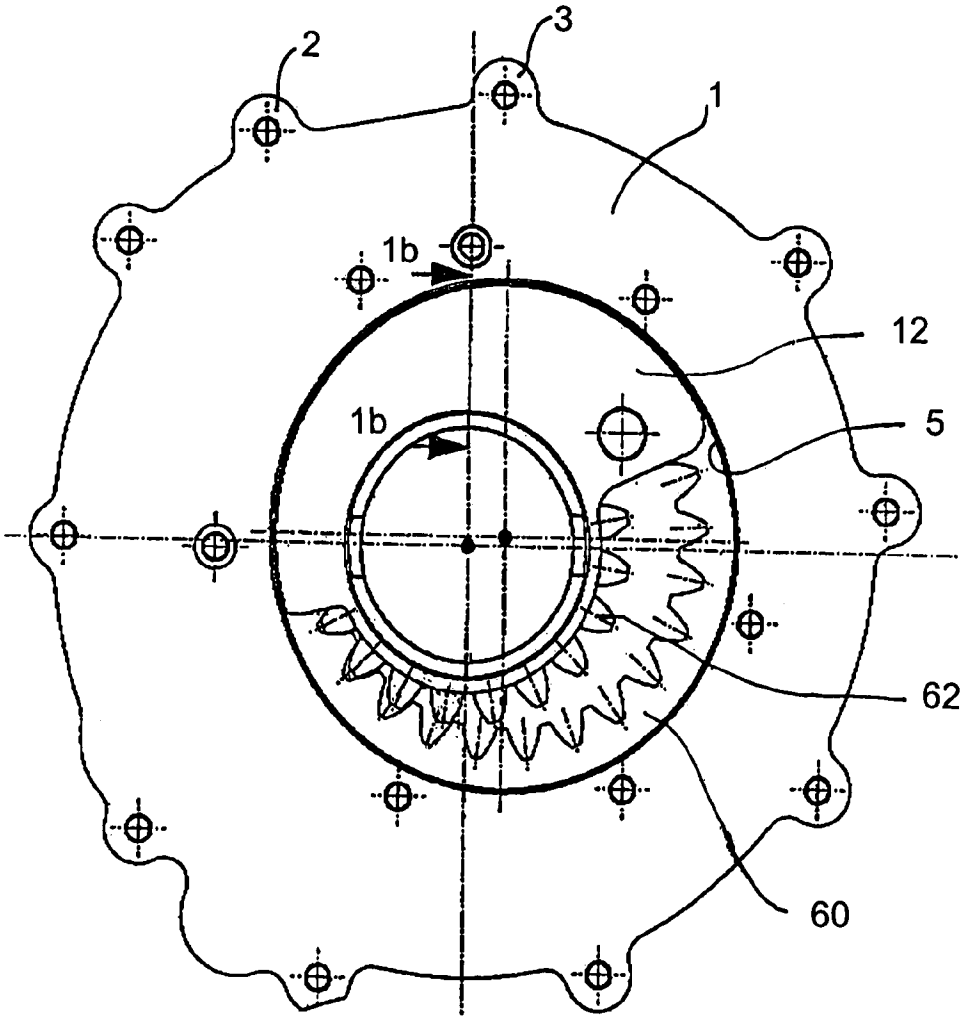
FIG. 1*a* is a top view similar to FIG. 1 and showing a ring gear and a pinion that provide a displacement unit.

FIG. 1 shows an internal gear pump having a housing 1, and FIG. 1*a* shows within housing 1 a ring gear 60 with internal teeth and a pinion 62 with external teeth. Ring gear 60 and pinion 62 are rotatably arranged and supported and provide a displacement unit. The pinion can be rotatably supported within the housing 1 by a tubular bearing. A shaft, such as a drive shaft, can extend through the tubular bearing. The drive shaft can have a connection element, such as a substantially annular flange element that is non-rotatably connected to the drive shaft and is also non-rotatably connected to the pinion 62, so that the pinion can be driven when the drive shaft is rotated. The flange element can have at least one radially inward projection, or several projections, that engage with opposed teeth or corresponding recesses in the shaft. Radially outward, the flange element can having external teeth or projections that engage with corresponding internal teeth or recesses in the pinion. Preferably, at least two, for example three, projections are provided that engage with corresponding receptacles in the pinion.

The housing 1 is substantially in the form of an enclosure with an attachment flange, around the periphery of which radially-outwardly-positioned attachment apertures 2, 3 are distributed. The attachment apertures 2, 3 serve to receive fastening elements (not shown), by means of which the housing 1 can be attached within the engine compartment of a motor vehicle.

Within the housing is a receiving chamber 5 for a the displacement unit. The displacement unit includes, for example, the gears described above. The structure and function of a gear pump, especially an internal gear pump, are presumed to be known to those skilled in the art and are therefore not further described herein Additionally, the housing 1 includes a bore 7 for receiving a portion of a drive shaft (not shown). Between the bore 7 and the outer periphery of the receiving chamber 5, are arranged a suction region 8 and a kidney-shaped pressure inlet 9. Formed in the region of the substantially kidney-shaped pressure inlet 9 is a pressure chamber 10 that is pressurized when the fluid delivery device is in operation. An axial plate 12, shown by dotted lines in FIG. 1, is provided within the housing 1 for axial clearance compensation. The principle of axial clearance compensation is similarly presumed to be known to those skilled in the art and is therefore also not further described herein.

Figure 2:
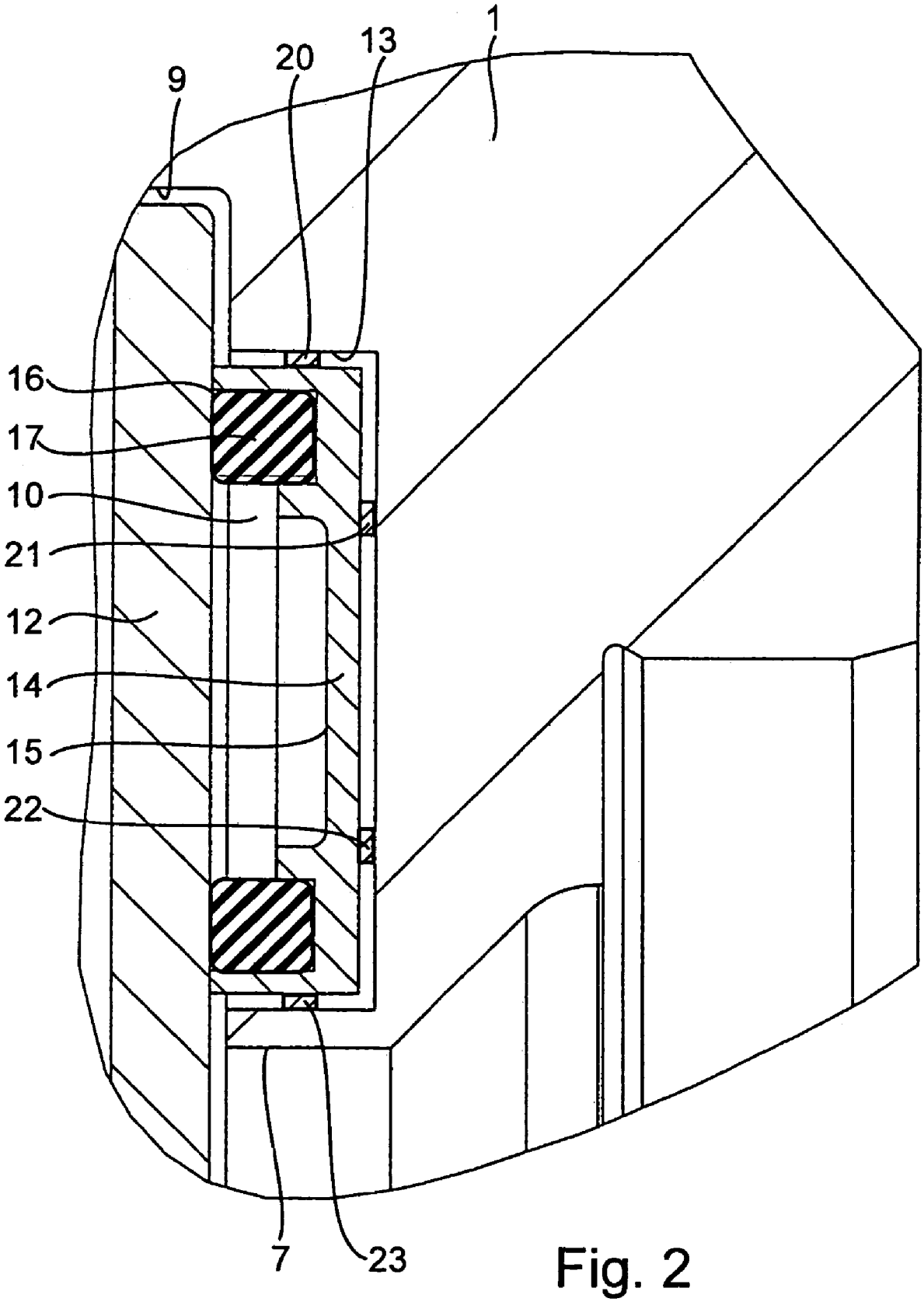
FIG. 2 is an enlarged view of a section taken along the line II—II of FIG. 1, in accordance with a first embodiment of the invention.

In FIG. 2, one can see that a recess 13 in the housing 1 has been hollowed out, in which a pressure plate 14 is received. The pressure plate 14 is provided with a recess 15, by which the pressure chamber 10 is formed. The pressure chamber 10 is therefore formed between the axial plate 12 and the pressure plate 14 in the region of the recess 15. The pressure plate 14 has at an edge region of recess 15 a peripheral groove 16, in which a seal 17 is partially received. A part of the seal 17 extends out of the groove 16 and is in contact with the axial plate 12 in order to seal the pressure chamber 10.

Figure 1B:
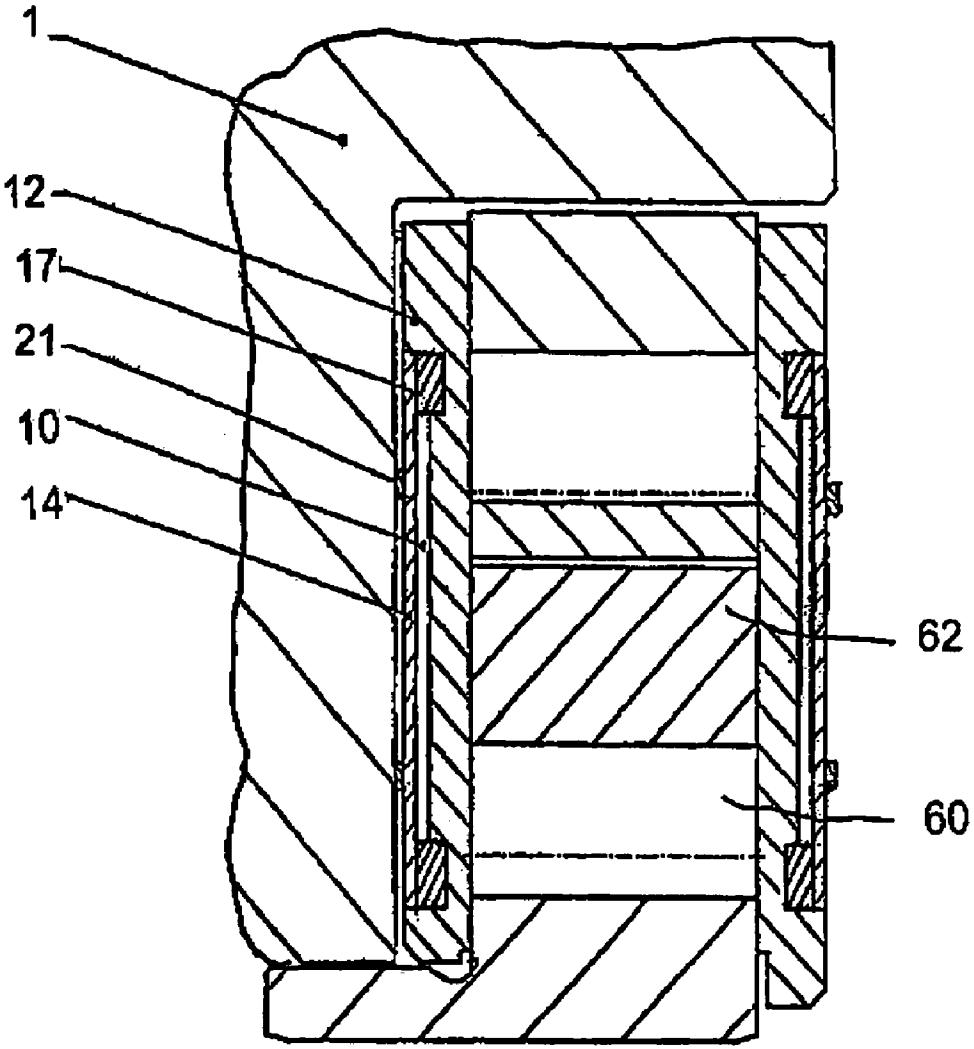
FIG. 1*b* is an enlarged, cross-sectional view taken in the direction of arrows 1*b* of FIG. 1.

Spacer elements 20, 21, 22, 23 are arranged on the sides of the pressure plate 14 opposite from the recess 15, between the pressure plate 14 and the housing 1. The spacer elements 20 to 23 serve to uncouple the pressure plate 14 from the housing 1. That uncoupling has the effect of preventing the transmission of structure-borne noise from the pressure plate 14 to the housing 1. The spacer elements 20 to 23 are so formed as to be able to compensate for slight movements of the pressure plate 14 relative to the housing 1, so that the pressure plate 14 does not come into contact with the housing 1. FIG. 1*b* is a longitudinal, cross-sectional view showing the several elements described above.

Figure 3:
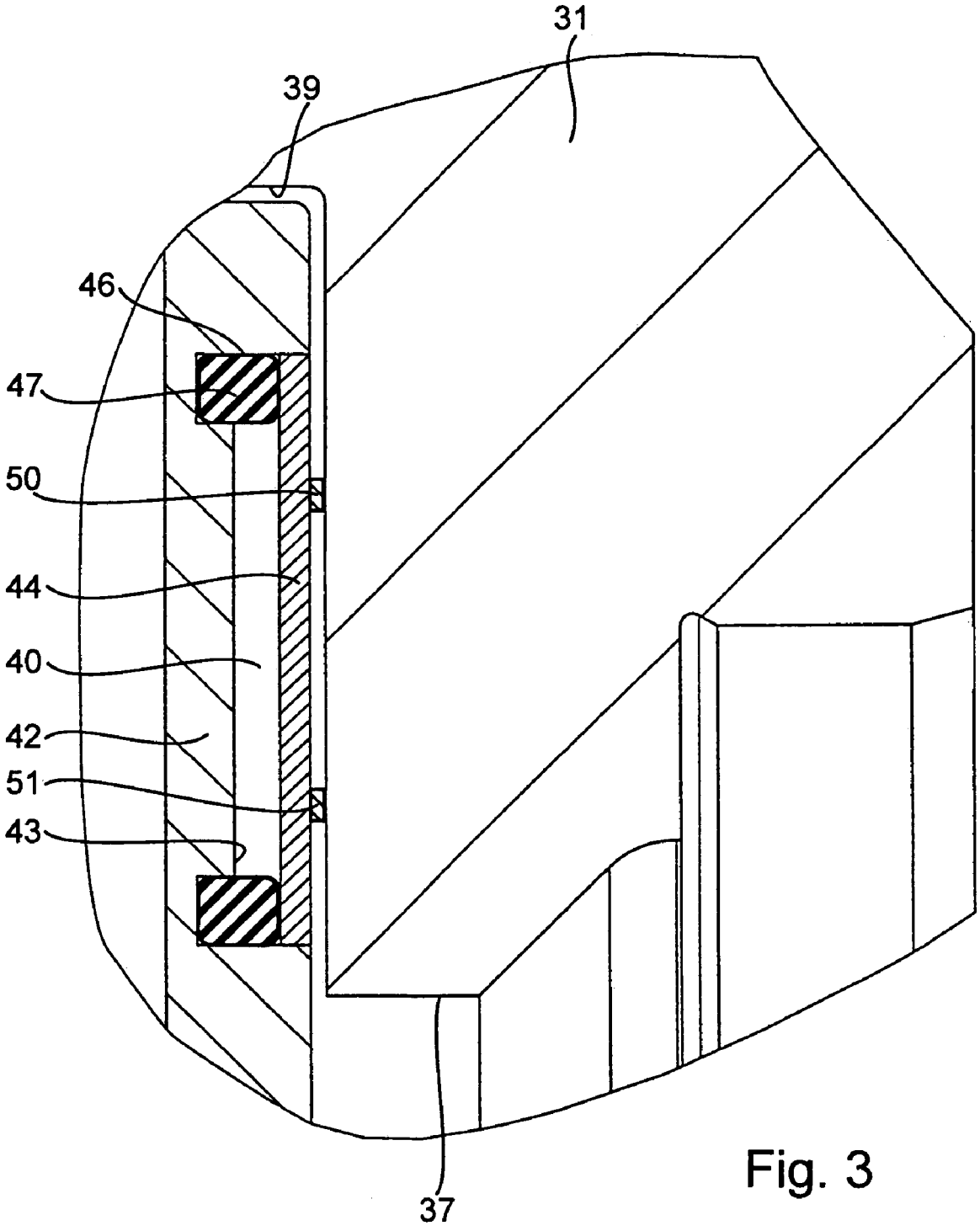
FIG. 3 is an enlarged view of a section taken along line II—II in FIG. 1, in accordance with a second embodiment of the invention.

FIG. 3 shows an enlarged view of a housing 31, in which are formed a bore 37 that is provided to receive a portion of a drive shaft (not shown), and a substantially kidney-shaped pressure inlet 39. A pressure chamber 40 is formed between a recess 43 in an axial plate 42. The way in which the medium to be supplied arrives at the pressure chamber 40 is not shown in either FIG. 3 or FIG. 2. The recess 43 in the axial plate 42 is closed by a pressure plate 44, whose dimensions correspond with the dimensions of the recess 43. Around the outer edge region of the recess 43 is a peripheral groove 46 within which a seal 47 is partially received. The part of the seal 47 that extends out of the groove 46 is in sealing contact with the pressure plate 44. The pressure plate 44, in practical terms, forms a piston that is received within the recess 43 to be movable back and forth. When pressure fluctuations occur in the pressure chamber 40, the pressure plate 44 can move slightly back and forth within the recess 43. The preferably elastic seal 47 thereby prevents the medium from flowing out of the pressure chamber 40.

On the other side of the pressure plate 44, spacer elements 50, 51 ensure that the pressure plate 44 is kept spaced from the housing 31 and does not contact it. That ensures that no structure-borne noise is transmitted from the pressure plate 44 to the housing 31.

By means of the spacer elements 20 to 23; 50, 51, the pressure chambers 10, 40, which can also be designated as pressure fields, are uncoupled from the housings 1, 31.

The solution in accordance with the invention can be applied to all pumps with axial pressure zones, in which the transmission of alternating forces in the pressure zone region on the housing structure should be prevented or attenuated.

Although particular embodiments of the present invention have been illustrated and described, it would be apparent to those skilled in the art that various changes and modifications can be made without departing from the spirit of the present invention. It is therefore intended to encompass within the appended claims all such changes and modifications that fall within the scope of the present invention.

What is claimed is:

1. A fluid delivery device with a housing including at least one receiving chamber, and a rotatable displacement unit arranged within the receiving chamber, whereby the displacement unit serves to supply a medium to at least one pressure chamber provided within the housing, said fluid delivery device comprising: a pressure plate positioned between the pressure chamber and the housing, wherein the pressure plate is arranged between the housing and an axial plate, the pressure chamber is formed between the pressure plate and the axial plate and the pressure plate is uncoupled from the housing by at least one spacer element that is arranged between the pressure plate and the housing.

2. A fluid delivery device in accordance with claim 1, wherein the pressure plate is at least partially received within a recess provided in the housing.

3. A fluid delivery device in accordance with claim 2, wherein at least one seal is arranged between the pressure plate and the axial plate.

4. A fluid delivery device in accordance with claim 3, including at least one groove formed in the pressure plate, whereby the groove serves to partially receive and to hold the seal.

5. A fluid delivery device in accordance with claim 2, including spacer elements arranged between the pressure plate and the housing both in a direction of an axis of rotation of the displacement unit and perpendicular thereto.

6. A fluid delivery device in accordance with claim 1, wherein the pressure plate is at least partially received within a recess provided in the axial plate.

7. A fluid delivery device in accordance with claim 6, wherein at least one seal is arranged between the pressure plate and the axial plate.

8. A fluid delivery device in accordance with claim 7, including at least one groove formed in the axial plate, whereby the groove serves to partially receive and to hold the seal.

9. A fluid delivery device in accordance with claim 1, wherein the displacement unit includes a first gear that is rotatably received within the housing and that cooperates with a second gear that is rotatably received within the housing.

10. A fluid delivery device in accordance with claim 1, wherein the at least one spacer element is made from a material selected from the group consisting of metals, sintered materials, plastic, and ceramics.

11. A fluid delivery device in accordance with claim 1, wherein the at least one spacer element is a resilient element.

12. A fluid delivery device in accordance with claim 1, wherein the at least one spacer element is made from an elastomeric material.

* * * * *